United States Patent [19]

Rodger

[11] 4,334,760

[45] Jun. 15, 1982

[54] TONER MECHANISM FOR ELECTROPHOTOGRAPHIC RECORDER

[75] Inventor: Erwin Rodger, Locust Valley, N.Y.

[73] Assignee: Litton Systems, Inc., Melville, N.Y.

[21] Appl. No.: 160,773

[22] Filed: Jun. 18, 1980

[51] Int. Cl.[3] ..... G03G 15/00

[52] U.S. Cl. ..... 355/3 DD; 118/656

[58] Field of Search ..... 355/3 DD, 16, 14 D; 118/657, 658, 623, 656; 430/122

[56] References Cited

U.S. PATENT DOCUMENTS

| | | | |
|---|---|---|---|
| 3,133,834 | 5/1964 | Sowiak | 118/657 |
| 3,572,922 | 3/1971 | Olden | 355/3 DD |
| 3,900,001 | 8/1975 | Fraser et al. | 118/658 |
| 3,921,577 | 11/1975 | Howard et al. | 118/658 |

FOREIGN PATENT DOCUMENTS

| | | | |
|---|---|---|---|
| 1442532 | 7/1976 | United Kingdom | 355/3 DD |

*Primary Examiner*—R. L. Moses

*Attorney, Agent, or Firm*—Robert F. Rotella; Michael H. Wallach

[57] ABSTRACT

A toner mechanism is shown which utilizes a paper roller to pass a sheet of paper between the roller and a toner brush where toner is applied to the surface of the paper and attracted to electrostatically charged portions on the surface thereof. The toner is retained within a reservoir whose opening is filled by the brush. The paper roller, located adjacent to the brush, draws the paper between the brush and roller. Rotation of the brush causes the toner to pass out of the opening within the reservoir while movement of the paper and roller tends to push the toner back into the reservoir through the opening. The ratio of rotational rates between the brush and paper roller and the size of the reservoir opening establish a meniscus of toner which is in equilibrium and thus self-regulating.

8 Claims, 2 Drawing Figures

TONER MECHANISM FOR ELECTROPHOTOGRAPHIC RECORDER

FIELD OF THE INVENTION

The present invention relates to electrophotographic recording and, more particularly, to an improved toner mechanism utilizing a toner reservoir which is closed by the combination of a toner brush and paper roller for controlling the application of toner upon the paper surface.

BACKGROUND OF THE INVENTION

It is well known in the prior art to utilize a dry toner or a powdered ink to dust the charged surface of a sheet of paper which has been electrostatically charged and then discharged by a beam of light, for example, reflected upon the surface of the paper. After the charged surface is discharged, the paper is exposed to the toner which adheres to the remaining charged areas. The paper is then exposed to a fuser which heats the toner to melt it into the paper and permanently affix it thereto.

Two electrophotographic processes are well known. The first, known as xerography, utilizes a photoconductive insulating medium which is exposed to electromagnetic energy such as infrared, visible or ultraviolet radiation. The charged photoconductive medium, which may be a selenium coated drum, is then dusted with a toner which is next transferred to a sheet of paper. The toner is then fused to the paper by heat. A second method utilizes a zinc-oxide-coated paper which receives an electrostatic charge and is discharged by electromagnetic energy directed upon the charged surface. The toner is then applied to the paper and fused as in the xerographic process.

Whether the electrophotographic recorder utilizes a selenium coated drum or zinc-oxide paper, the requirement to properly expose a surface to a desired amount of toner remains unchanged. Further, the need to uniformly apply the toner to the surface without creating voids within the toner also remains.

SUMMARY OF THE INVENTION

Accordingly, it is an object of the present invention to provide an improved toner mechanism for electrophotographic recorders which controls the amount of toner applied to a surface over a given path length.

Another object of the present invention is to provide a toner mechanism for uniformly applying toner to a charged surface wherein the toner is free of voids which could cause unprinted areas on the surface of a paper.

In accomplishing these objects, there is provided a toner reservoir having an opening which is partially closed by a toner brush. Juxtaposed in a parallel position beside the toner brush is a paper roller which introduces paper between the roller and the toner brush. Rotation of the toner brush and paper roller introduce toner to the surface of the paper where a fixed path length of the paper is exposed to the toner. The toner is urged from the opening of the toner reservoir by the rotation of the toner brush and urged back into the reservoir by the rotation of the paper roller and the paper upon that roller. In this manner, the toner establishes an equilibrium position in the form of a convex meniscus which becomes self-regulating. Excess toner is transported back into the toner reservoir where it remains until the level of the toner begins to subside, at which time the excess toner is available to retain the established meniscus. Thus, the size of the meniscus remains stationary and void-free for controlling the exposure of the paper to toner.

The size of the meniscus may be controlled by a toner level gate. It is also possible to control the size of the meniscus by adjusting the ratio of the rate of rotation between the toner brush and paper roller.

DETAILS OF THE PREFERRED EMBODIMENT

Figure 1:
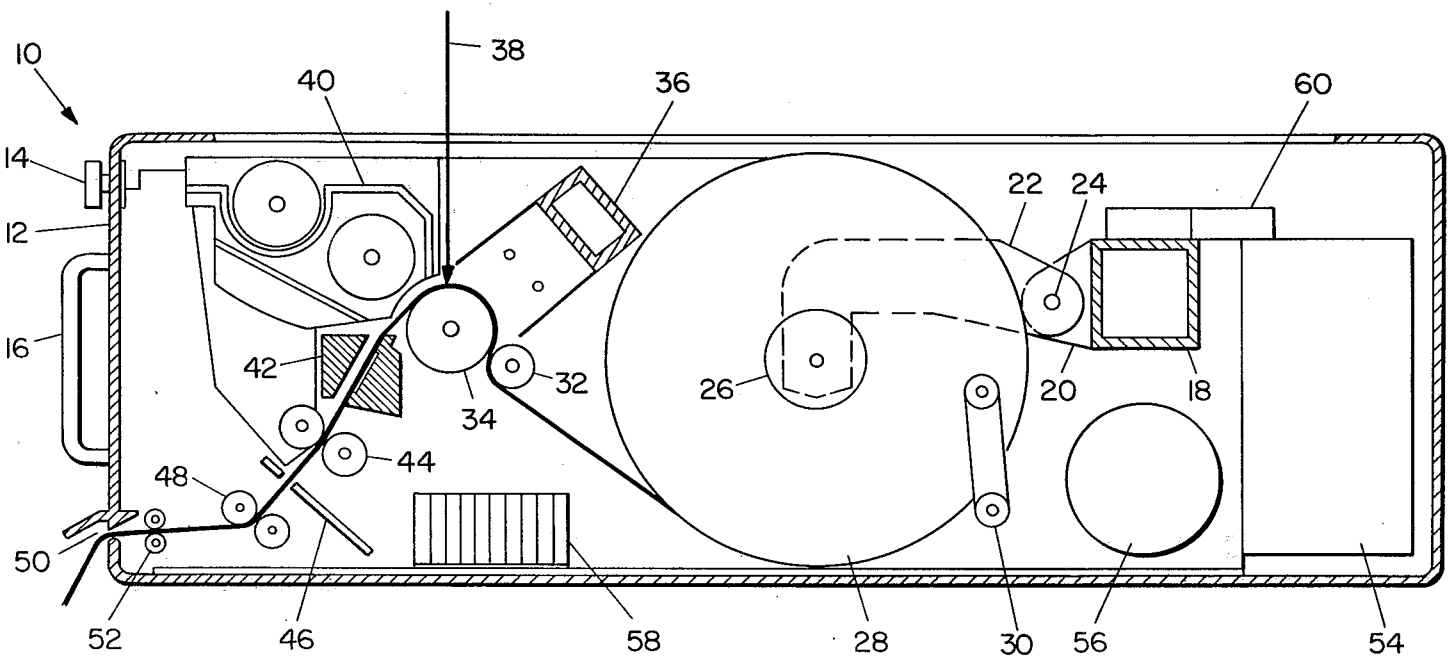
FIG. 1 is a cross-sectional view showing an electrophotographic recorder which incorporates the toner mechanism of the present invention.

Referring now to FIG. 1, an electrophotographic recorder 10 is shown mounted within a housing 12 which, in turn, may be mounted within a rack of electronic equipment, not shown. The housing 12 is provided with latches 14 and handles 16 to facilitate rack mounting upon slides, not shown. Removal of the housing 12 from the rack upon its slides will expose the upper surface of the housing which may be open, when mounted within a rack, or closed by a cover, when used upon a bench.

Mounted within the housing 12 is a box-beam frame 18 having support tabs 20 extending therefrom which form a pivot point for a mounting frame 22 attached to the tabs 20 by pins 24. The frame 22 mounts a paper supply roller 26 about which is wound a quantity of paper 28 which, in the preferred embodiment, is a roll 8½ inches wide by 400 feet long. As the paper 28 is spooled from the roller 26, the level of paper upon the roll is sensed by a paper level sensor 30, such as a following roller attached to a lever arm which actuates a cam switch when the lever arm reaches a predetermined position indicating that a short length of paper remains upon the roller.

As the paper 28 is spooled from the roller 26, it passes over a first guide roller 32 and wraps about a paper roller 34. The paper roller 34 has a larger diameter than the guide rollers to enable the paper 28 to be electrostatically charged by a charger 36, such as a corona electrostatic charger which imparts an electrical charge, generally in the dark, to a photoconductive material, such as a zinc-oxide coating upon the paper 28. As the paper 28 departs the corona charger 36 it is struck by electromagnetic energy, illustrated by a beam 38. The electromagnetic energy may be infrared, visual radiation or ultraviolet radiation. In the preferred embodiment, the radiation comes from the coherent light beam of a laser.

After the paper has been charged by the corona charger 36 and discharged by the light beam 38, it is exposed to a toner assembly 40 where toner is applied over a fixed path length $\theta$ of the paper 28, as will be described in FIG. 2 below. The toner which was adhered to the remaining charged surfaces of the paper 28 next passes through a fuser 42 which heats the paper and toner to fuse the toner permanently to the paper. In the preferred embodiment, the toner is formed as powdered dry ink which, when exposed to heat, adheres to the paper.

The paper 28 is then pulled from the fuser 42 by pinch rollers 44 and driven past a shear 46 by a second pair of pinch rollers 48. The paper then exits through an exit aperture 50 under the drive of a last pair of pinch rollers 52.

The housing 12 has been provided with adequate room for a power supply 54, shear and pinch roller motor 56, and electronics 58. Also provided are rack and panel connectors 60 which supply power to the power supply 54 and necessary input telemetry to the electronics 58. As the zinc-oxide-coated paper 28 must be exposed to electromagnetic energy from an external source in the embodiment shown, the upper surface of the housing 12 is open to permit the passage of the electromagnetic energy, beam 38, or provided with a slot when a cover is utilized.

Figure 2:
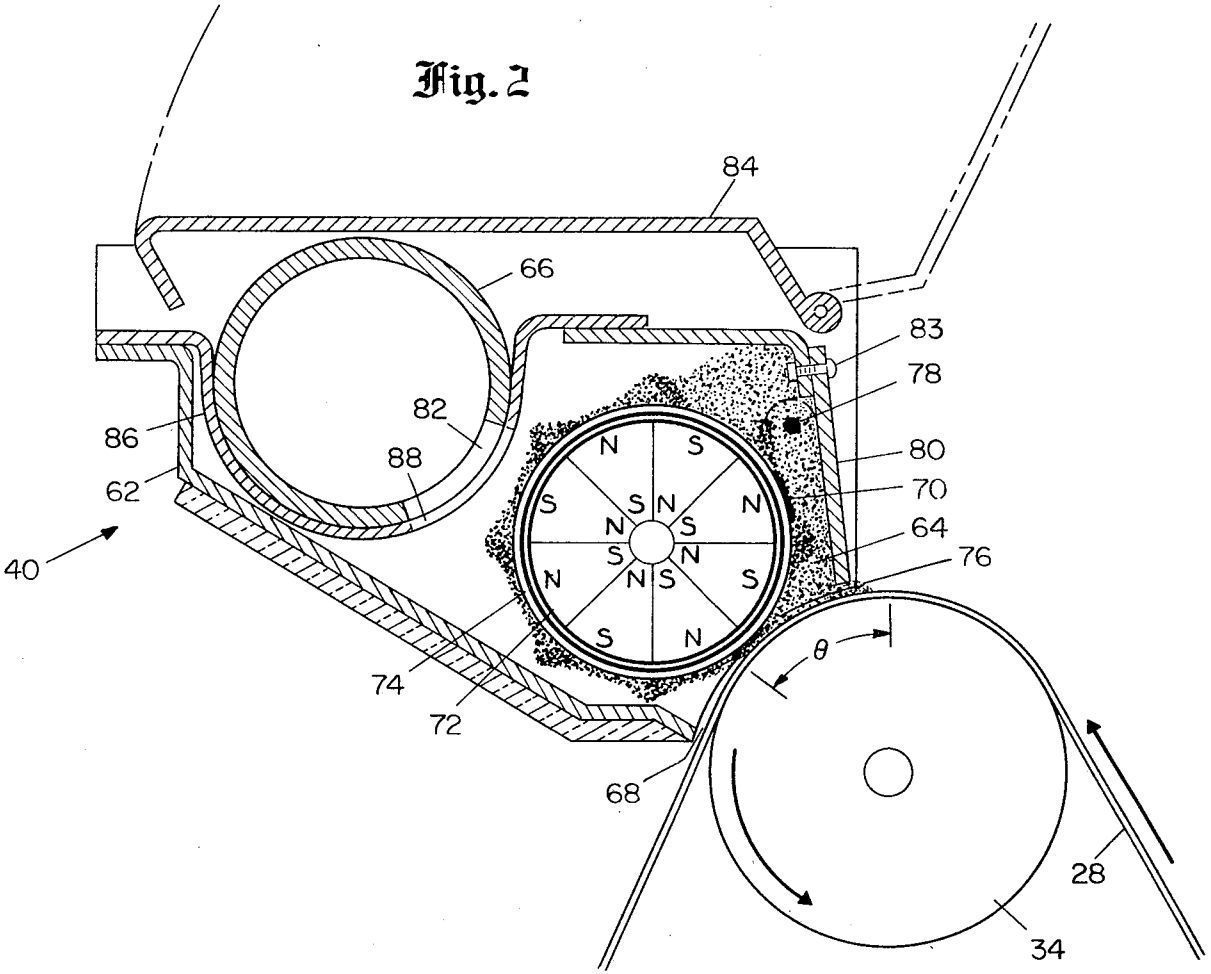
FIG. 2 is a cross-sectional view showing the toner mechanism in greater detail.

Referring now to FIG. 2, the details of the toner mechanism assembly 40 are shown wherein the paper 28 passes over the top of the paper roller 34 and under the toner assembly 40. The toner assembly 40 consists of a container 62 that may be formed from molded plastic, cast aluminum, or sheet metal to create a reservoir for a powdered toner 64. In the preferred embodiment, the toner container 62 is a long, narrow container having a polygonal cross-section whose lower surface slopes in an upward direction, as one moves away from the paper roller, toward a toner cartridge 66 which supplies the toner 64 to the container 62. The lowermost corner of the container 62 is provided with an opening 68 which is closed, at least partially, by a toner brush assembly 70. The opening 68 extends longitudinally along the full periphery of the paper roller 34 so that the combination of the toner brush assembly 70 and paper roller 34 substantially close the toner container opening 68. The paper thus passes between the roller 34 and the toner brush assembly 70 due to the counterclockwise rotation of the paper roller 34 driven by motor 56.

The toner brush assembly 70 includes a cylindrical magnetic roller 72 which may be formed from a plurality of permanent magnets having north to south poles running longitudinally along the axis of the magnetic roller 72. Alternately, the magnetic roller 72 may be formed from permanent magnet material that has been magnetized to form longitudinal poles along the surface thereof parallel to its axis of rotation. The magnetic roller 72 also rotates in a counterclockwise direction driven by motor 56.

A thin sleeve of nonmagnetic material 74 covers the magnetic roller 72 which is capable of rotation but is normally fixed so that the sleeve does not rotate on a continuous basis. The sleeve 74, which may be constructed from a thin aluminum tube, is placed as close to the magnetic poles formed within the magnetic roller 72 as practical since penetration of the magnetic field into the toner container 62 is desired. As the magnetic roller 72 rotates in a counterclockwise direction, the magnetic field established by the rotating magnetic poles causes the toner 64, which is a magnetic powdered ink, to move in response to the magnetic field. The toner movement is a flipping movement in a direction opposite the direction of rotation of the magnetic roller. Thus, the motion of the toner in a clockwise direction, in combination with the rotation of rollers 34, creates the effect of pinching the toner into the space formed between the rotating paper roller 34 and the fixed toner sleeve 74.

This pinching effect causes the excess toner to pile up behind the space between roller 34 and sleeve 74. As the toner 64 builds up, it trys to spill out of the opening between the toner gate 80 and roller 34. Because of the magnetic attraction between the toner particles and the internal pressure of the toner, a convex toner meniscus 76 is formed on the paper 28. This meniscus 76 assisted by the motion of paper 28 which is being fed into the opening by the rotation of roller 34 establishes an equilibrium condition. This equilibrium condition prevents excess toner from exiting the toner mechanism 40 and spilling. As the amount of toner is depleted within the meniscus 76, the toner level in the reservoir drops to replenish the meniscus. A toner level sensor 78, such as a light-sensitive diode and light emitting source, may be provided in the reservoir to indicate when the toner level drops below a desired reserve.

In the preferred embodiment, the magnetic roller rotates seven times faster than the paper roller. Other ratios have been utilized in place of this 7 to 1 ratio, such as: a 3 to 1 ratio, a 6 to 1 ratio, a 9 to 1 ratio, and a 12 to 1 ratio. As mentioned, it has been found that the 7 to 1 ratio appears to work best in the embodiment described.

A second adjustment of the convex meniscus 76 may be accomplished by adjusting the level of a toner gate 80 formed at the right-hand vertical surface of the toner container 62. The toner gate may be adjusted up and down by adjusting screws 83 to vary the size of the meniscus 76. In the preferred embodiment, a space of approximately 1/32 of an inch between the gate 80 and paper roller 34 has been found satisfactory. By adjusting the rotational ratio between the magnetic toner brush assembly 70 and the paper roller 34 and by adjusting the space of the opening 68 between the top of roller 34 and the bottom of toner gate 80, one may adjust the size of the meniscus 76. The size of meniscus 76 establishes the paper path length $\theta$ that is exposed to the toner 64.

As the charged paper 28 passes under the toner opening 68, the toner 64 is attracted to the charged surface areas of the paper. Excess toner which does not adhere to the paper is carried away from the paper by the rotational motion of the magnetic roller 72. The size of the space between the toner brush assembly 70 and the paper 28 upon roller 34 is established small enough to assure that the strength of the magnetic poles within the magnetic roller 72 will attract and carry off all excess toner which has not adhered to the paper yet large enough to permit a smooth uniform flow of void-free toner.

The magnetic roller 72 within the sleeve 74 stirs the toner to assure that the toner is free of voids. This stirring action continues within the reservoir formed behind gate 80 and is enhanced by the action of the paper which forms the meniscus. The need for a void-free toner in the space between the brush assembly 70 and roller 34 is clear when it is remembered that a void will prevent toner from being applied to a charged area thus leaving a white space where black is required.

In the preferred embodiment, the toner 64 is placed within the cylindrical toner cartridge 66 which is formed with a longitudinal, peripheral aperture 82 at least as long as the width of the paper 28. To load the toner container 62, a container cover 84 is opened and the toner cartridge 66 placed into an appropriate semicircular receptacle 86. The semicircular receptacle 84 is provided with a longitudinal aperture 88 which extends along its lower, inner surface adjacent the toner brush assembly 70. The toner cartridge aperture 82 is closed by a suitable closure, such as a flexible plastic sheet adhered to the container 66 or a second cylindrical tube having a second aperture. Removal of the adhesive sheet or rotation of the second cylinder exposes the aperture 82. The toner cartridge 66 is then placed in the receptacle 84 and rotated until apertures 82 and 88 are aligned causes the toner 64 to spill through the apertures into the toner container reservoir 62. As will be seen in FIG. 2, the arrangement of the toner cartridge 66, toner container 62 and the semicircular toner receptacle 84 prevents toner from spilling or accidentally flying into unwanted areas. The arrangement also enhances a void free toner at meniscus 76.

While the rate of rotational rate between the toner brush assembly 70 and the paper roller 34 has been described as 7 to 1 and the space between the toner gate 80 and the paper roller 34 is described as 1/32 of an inch, it will be apparent to those skilled in the art that other dimensions and other arrangements are possible and that the present invention should be limited only by the appended claims.

We claim:

1. In an electrophotographic recorder having paper roller means for transporting charged paper and toner brush means for exposing said charged paper to toner, the improvement comprising:

a toner reservoir having an opening, said toner brush means rotatably mounted within said opening for partially closing said opening, said paper roller means rotatably spaced from said toner brush means and further closing said opening for permitting the entrance and exit of said paper from between said brush means and said paper roller means while preventing the exit of said toner but for that toner adhered to said charged paper, said toner brush means and said paper roller means rotating at a predetermined ratio in the same direction to draw said paper and said toner into mutual contact one with the other wherein the length of said mutual contact is adjusted by adjustment of said rotation rate;

said toner brush means and said paper roller means rotating toward one another for drawing said paper therebetween from above said paper roller means, said toner reservoir opening and said space between said toner brush means and said paper roller means established to permit said toner to pass out of said opening onto said paper and form a meniscus upon said paper, said rotation of said toner brush means and said paper roller means established at said predetermined ratio to place the movement of said toner onto said paper and said meniscus established thereby in equilibrium wherein the size of said toner meniscus remains unchanged with excess toner stored in said toner reservoir;

establishing said predetermined ratio of rotational rate between said toner brush means and said paper roller means at 7 to 1; and gate means adjustably mounted upon said toner reservoir for closing said opening wherein adjustment of said gate means controls the movement of said toner onto said paper and thereby establishes the size of said toner meniscus.

2. In an electrophotographic recorder, as claimed in claim 1, the improvement additionally comprising said toner brush means including:

a rotatable cylindrical roller having north and south magnetic poles disposed longitudinally along its surface, and a fixed sleeve covering said magnetic rotatable cylindrical roller wherein movement of said toner is established by rotation of said magnetic rotatable cylindrical roller within said fixed sleeve.

3. An electrophotographic recorder for recording an image upon a sheet of paper having charged surface areas thereon, comprising:

a toner reservoir having an opening therein, a rotatable toner brush assembly mounted within said opening, and a rotatable paper roller for conveying said paper to said toner brush assembly within said reservoir opening and for exposing said charged surface areas thereon to said toner, said rotatable toner brush assembly and said rotatable paper roller moving said toner and said paper in the same direction, said rotatable toner brush assembly and said rotatable paper roller spaced one from the other to permit said paper and that portion of said toner which adheres to said charged surface areas thereon to pass there between while preventing the passage of additional toner, said additional toner forming a meniscus upon said paper as said paper passes between said toner brush assembly and said paper roller the size of which controls the length of said paper exposed to said toner, and said toner reservoir including an adjustable gate for adjusting the size of said reservoir opening and thereby the size of said meniscus.

4. An electrophotographic recorder, as claimed in claim 3, wherein said toner brush assembly includes:

a rotating magnetic cylinder and a fixed sleeve surrounding said magnetic cylinder.

5. An electrophotographic recorder, as claimed in claim 3, wherein:

said rotatable toner brush assembly and said rotatable paper roller rotate at a 7 to 1 ratio, respectively.

6. An electrophotographic recorder, as claimed in claim 3, wherein:

said size of said reservoir opening is established by the distance said adjustable gate is spaced from said paper roller.

7. An electrophotographic recorder, as claimed in claim 6, wherein said space between said paper roller and said adjustable gate is 1/32 of an inch.

8. An electrophotographic recorder, as claimed in claim 3, wherein:

said toner prevented from passing between said toner brush assembly and said paper roller first forms said meniscus until said meniscus becomes equalized by the motion of said paper and then is received into said reservoir; and the size of said meniscus is established by the rotational ratio of said toner brush assembly to said paper roller and the size of said reservoir opening.

* * * * *